US008439646B2

(12) United States Patent
Guemmer

(10) Patent No.: US 8,439,646 B2
(45) Date of Patent: May 14, 2013

(54) ENGINE BLADE WITH EXCESSIVE LEADING EDGE LOADING

(75) Inventor: Volker Guemmer, Mahlow (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 585 days.

(21) Appl. No.: 12/815,122

(22) Filed: Jun. 14, 2010

(65) Prior Publication Data

US 2011/0014057 A1 Jan. 20, 2011

(30) Foreign Application Priority Data

Jul. 17, 2009 (DE) ..... 10 2009 033 593

(51) Int. Cl.
*F01D 5/14* (2006.01)

(52) U.S. Cl.
USPC ..... 416/223 R; 416/243; 416/223 A; 416/241 R; 416/DIG. 2; 416/DIG. 5; 415/219.1; 415/220; 415/227; 415/914

(58) Field of Classification Search ..... 416/223 R, 416/243, 223 A, 228, 238, 242, 241 R, DIG. 2, 416/DIG. 5; 415/182.1, 219.1, 220, 227, 415/914
See application file for complete search history.

(56) References Cited

U.S. PATENT DOCUMENTS

| | | | | |
|---|---|---|---|---|
| 4,431,376 | A | 2/1984 | Lubenstein et al. | |
| 4,961,686 | A * | 10/1990 | Blair et al. | 416/223 A |
| 5,167,489 | A * | 12/1992 | Wadia et al. | 415/182.1 |
| 5,525,038 | A | 6/1996 | Sharma et al. | |
| 6,428,281 | B1 | 8/2002 | Botrel et al. | |
| 7,204,676 | B2 * | 4/2007 | Dutton et al. | 416/238 |

FOREIGN PATENT DOCUMENTS

| | | |
|---|---|---|
| DE | 69507509 | 9/1999 |
| EP | 1077309 | 2/2001 |

OTHER PUBLICATIONS

German Search Report dated Jun. 16, 2010 from corresponding foreign application.

* cited by examiner

*Primary Examiner* — Igor Kershteyn
(74) *Attorney, Agent, or Firm* — Timothy J. Klima; Shuttleworth & Ingersoll, PLC

(57) ABSTRACT

A free end of a blade of a fluid flow machine has a skeleton line camber distribution having an excessive value to a relative skeleton line camber of at least $\alpha^*=0.35$ for a related running length of $s^*=0.1$ in a blade profile flow line section between the free end and a blade section at 30% of a main flow path width from the free end. S* is a local running length relative to a total running length of the profile skeleton line and $\alpha^*$ is an angular change of the skeleton line relative to a total camber of the skeleton line from a leading edge to a related running length s*. The skeleton line camber distribution runs between leading edge point V ($s^*=0$, $\alpha^*=0$) and trailing edge point H ($s^*=1$, $\alpha^*=1$).

20 Claims, 6 Drawing Sheets

Figure 2:
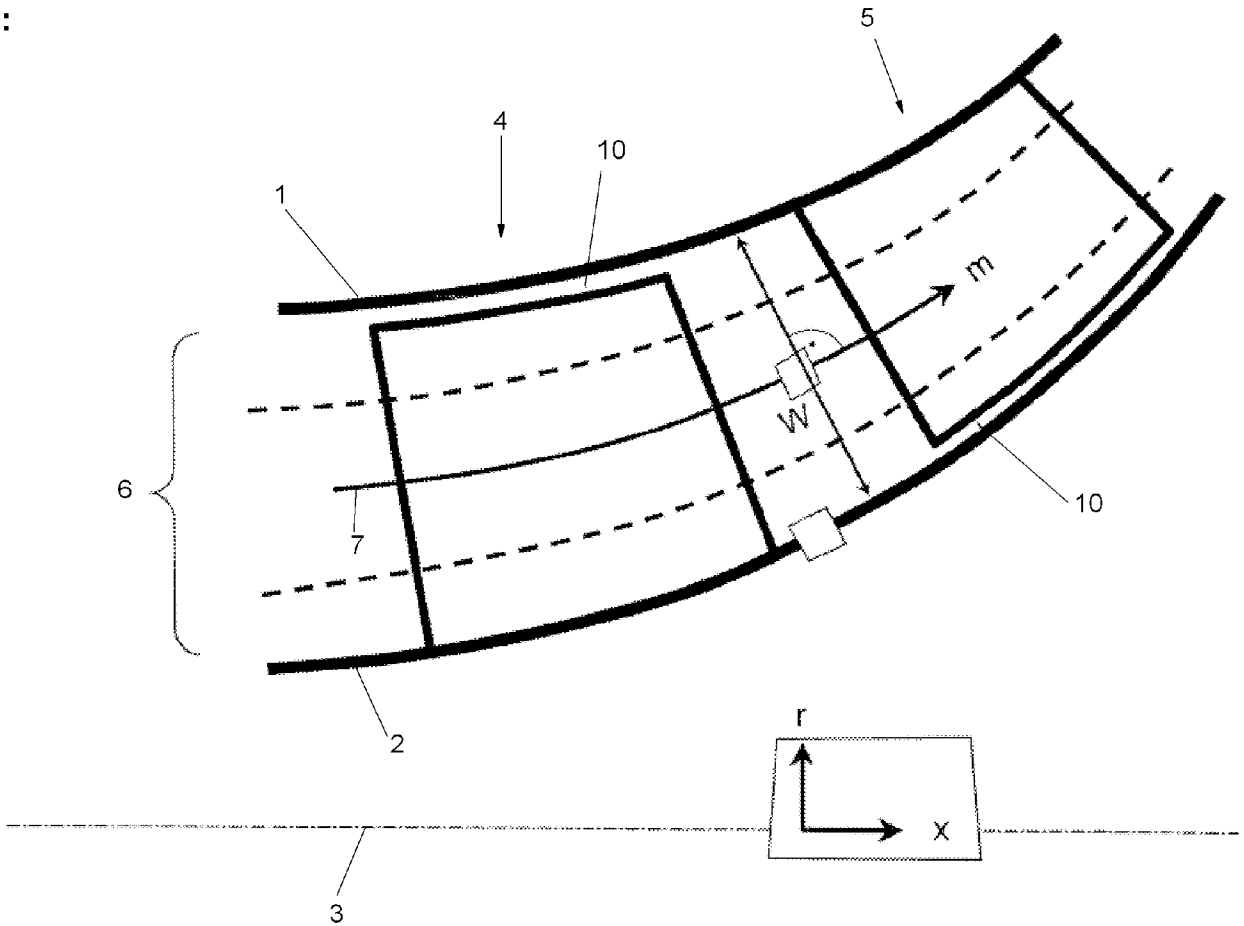

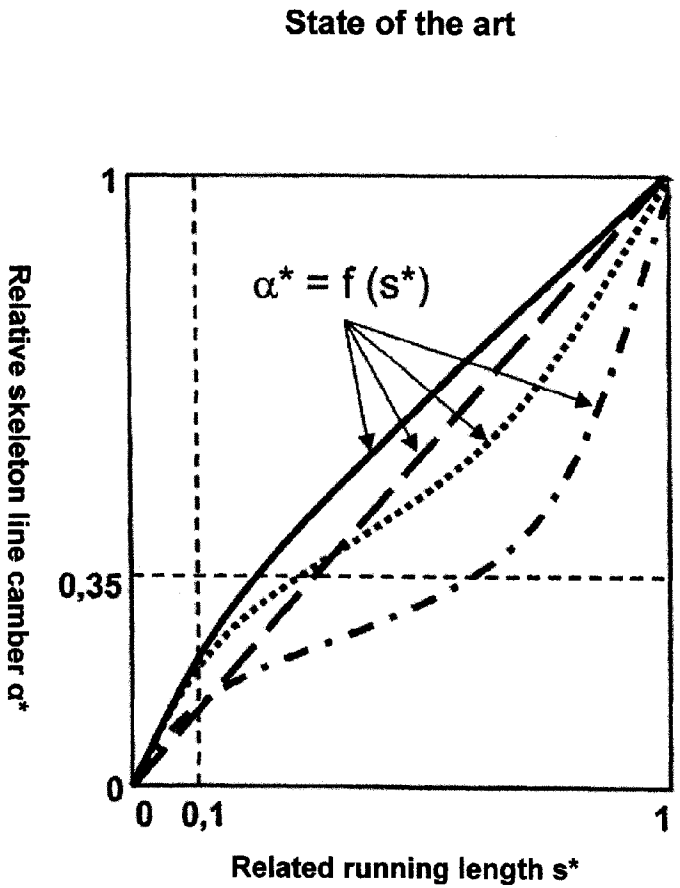
Fig. 1:
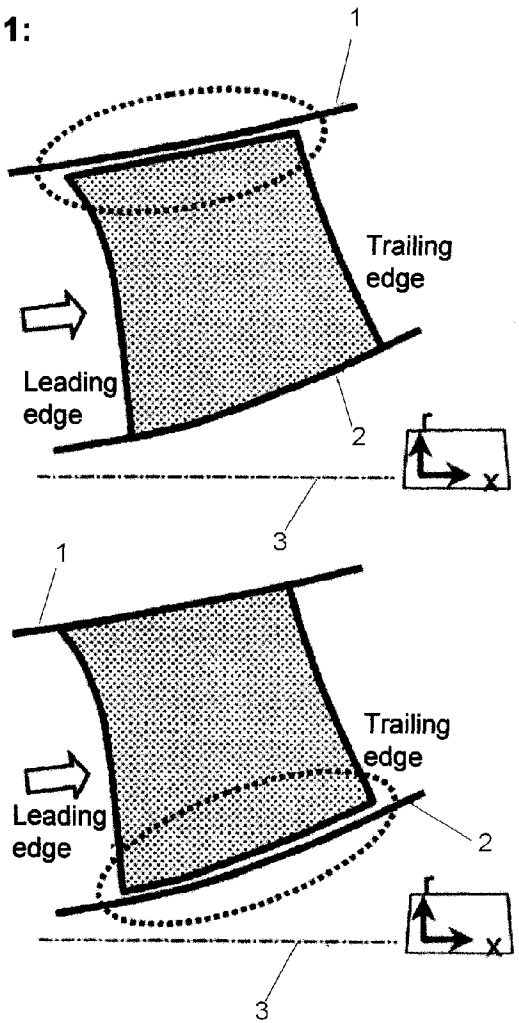

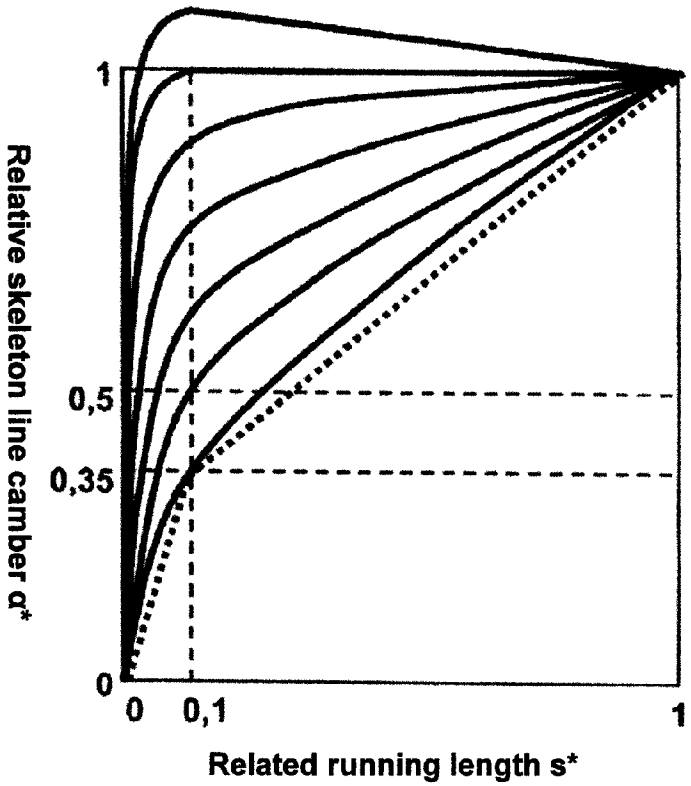
Fig. 4a:
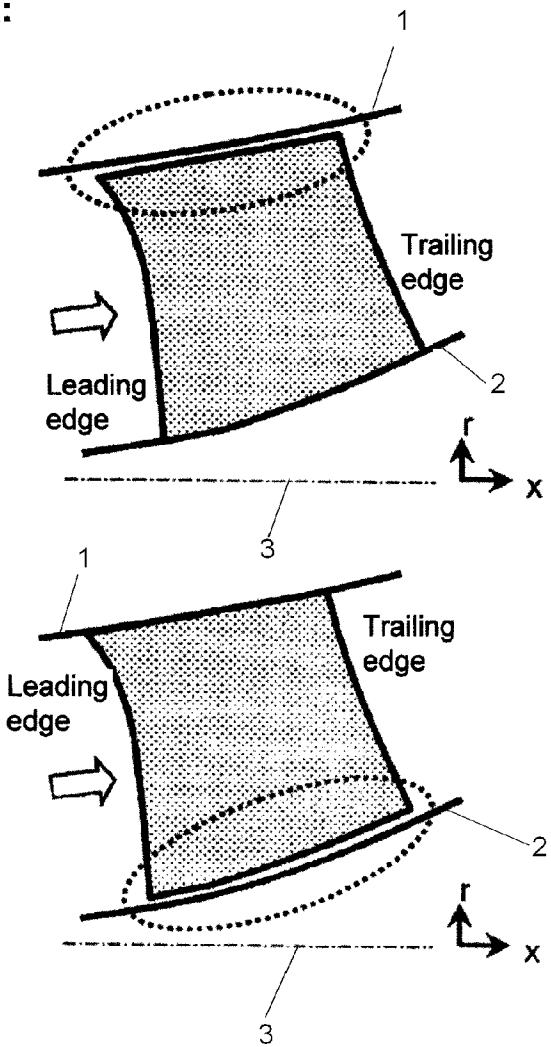

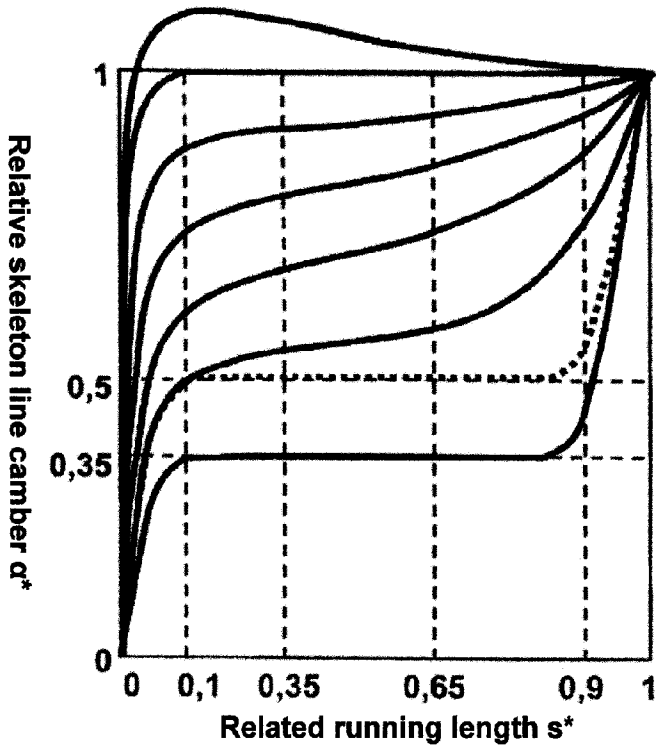
Fig. 4b:
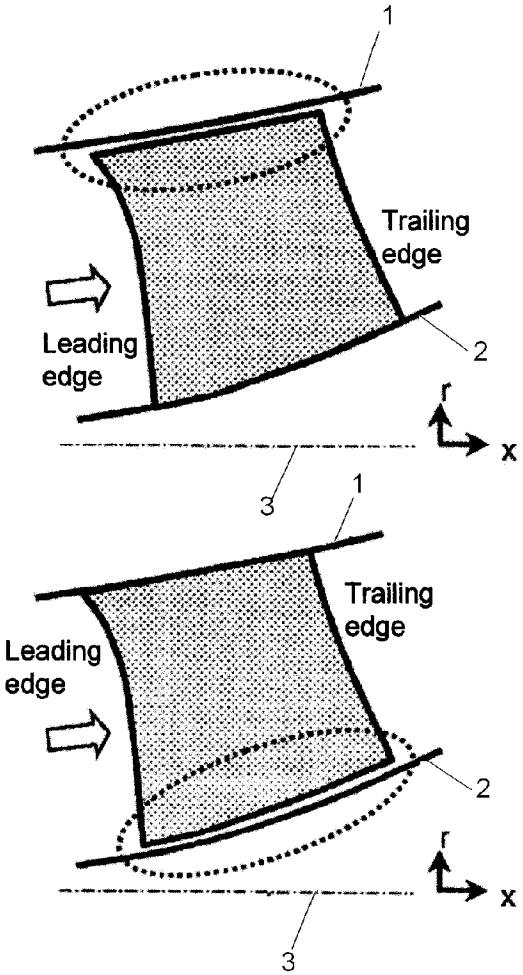

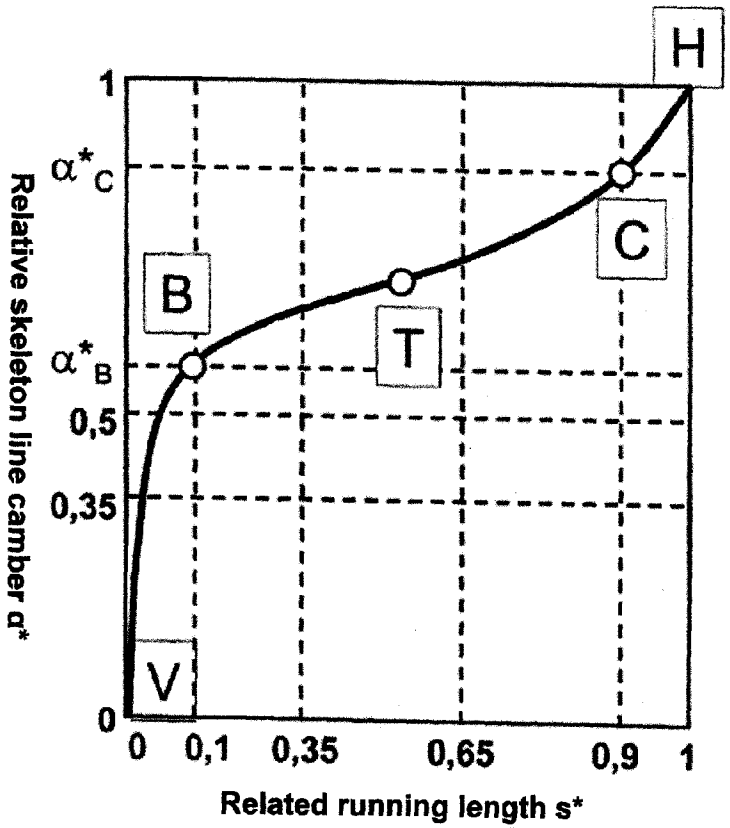
Fig. 4c:
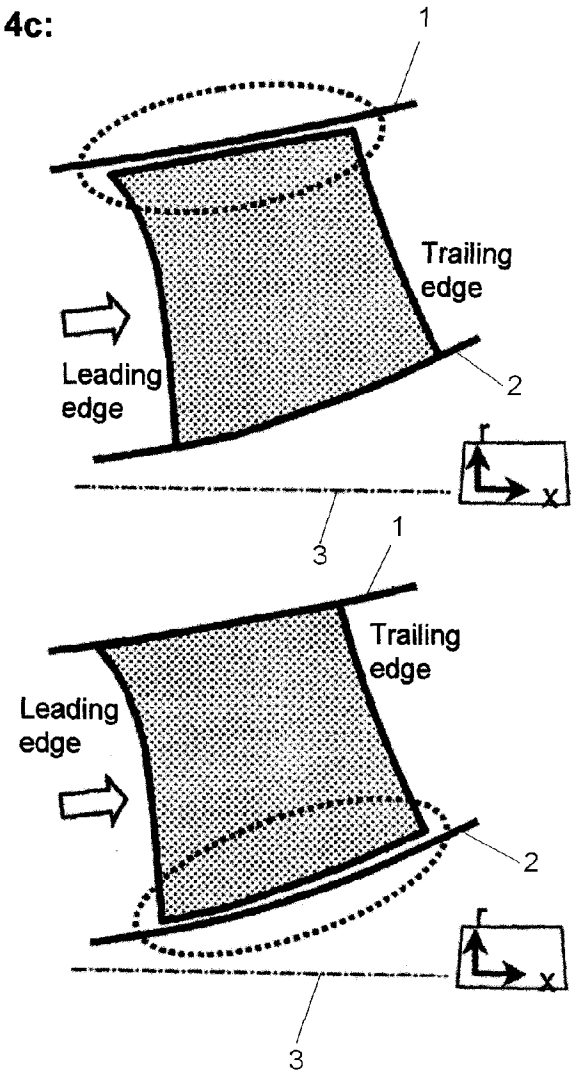

ENGINE BLADE WITH EXCESSIVE LEADING EDGE LOADING

This application claims priority to German Patent Application DE102009033593.5 filed Jul. 17, 2009, the entirety of which is incorporated by reference herein.

The present invention relates to an engine blade with excessive leading edge loading.

The aerodynamic loadability and the efficiency of fluid flow machines, for example blowers, compressors, pumps and fans, is limited in particular by the growth and the separation of boundary layers in the area of the rotor and stator radial gaps and of the firmly attached blade ends near the walls of the annulus. The state of the art only partly provides solution to this fundamental problem. The general concept of boundary influencing by changing the type of skeleton line along the blade height is provided in the state of the art, however, the known solutions are not adequate and, therefore, of limited effectiveness only, in particular for the flow conditions at a blade end with radial gap.

More particularly, this invention relates to at least one blade of a fluid flow machine. The respective blading is situated within a main flow path, which is confined on the outside by a casing and on the inside by a hub. While a rotor includes several rotor blades attached to a rotating shaft and transfers energy to the working medium, a stator has several stator vanes mostly fixed in the casing.

The present invention relates to a rotor with firm attachment to a rotating hub and a free blade end with gap at the casing. Analogically, the present invention relates to a stator which peripherally is firmly connected on the casing side and whose blade end is free with a gap to the hub on the hub side.

The present invention relates to blades of fluid flow machines, such as blowers, compressors, pumps and fans of the axial, semi-axial or radial type. The working medium (fluid) may be gaseous or liquid.

The following is known from the state of the art:

FIG. 1 schematically shows on the left-hand side two blade configurations in the meridional plane defined by the radial direction r and the axial direction x, these blade configurations corresponding to the state of the art. This is a rotor blade row 4 with gap on the casing 1 (top), with the casing 1 being stationary, or in special cases also rotary, and the blade row being rotary about the machine axis 3. The invention furthermore relates to a stator vane row 5 with gap on the hub 2 (bottom), with the hub 2 being rotary about the machine axis 3, or in special cases also stationary, and the vane row 5 being stationary. According to the state of the art, the blade profile section immediately on the running gap of a rotor 4 or stator 5 is designed such that the profile load and, thus, the profile camber in the area of the leading edge does not exceed a certain level, in observance of the recommendations of conventional design rules based on considerations on the nature of two-dimensional flows around profiles.

Figure 3:
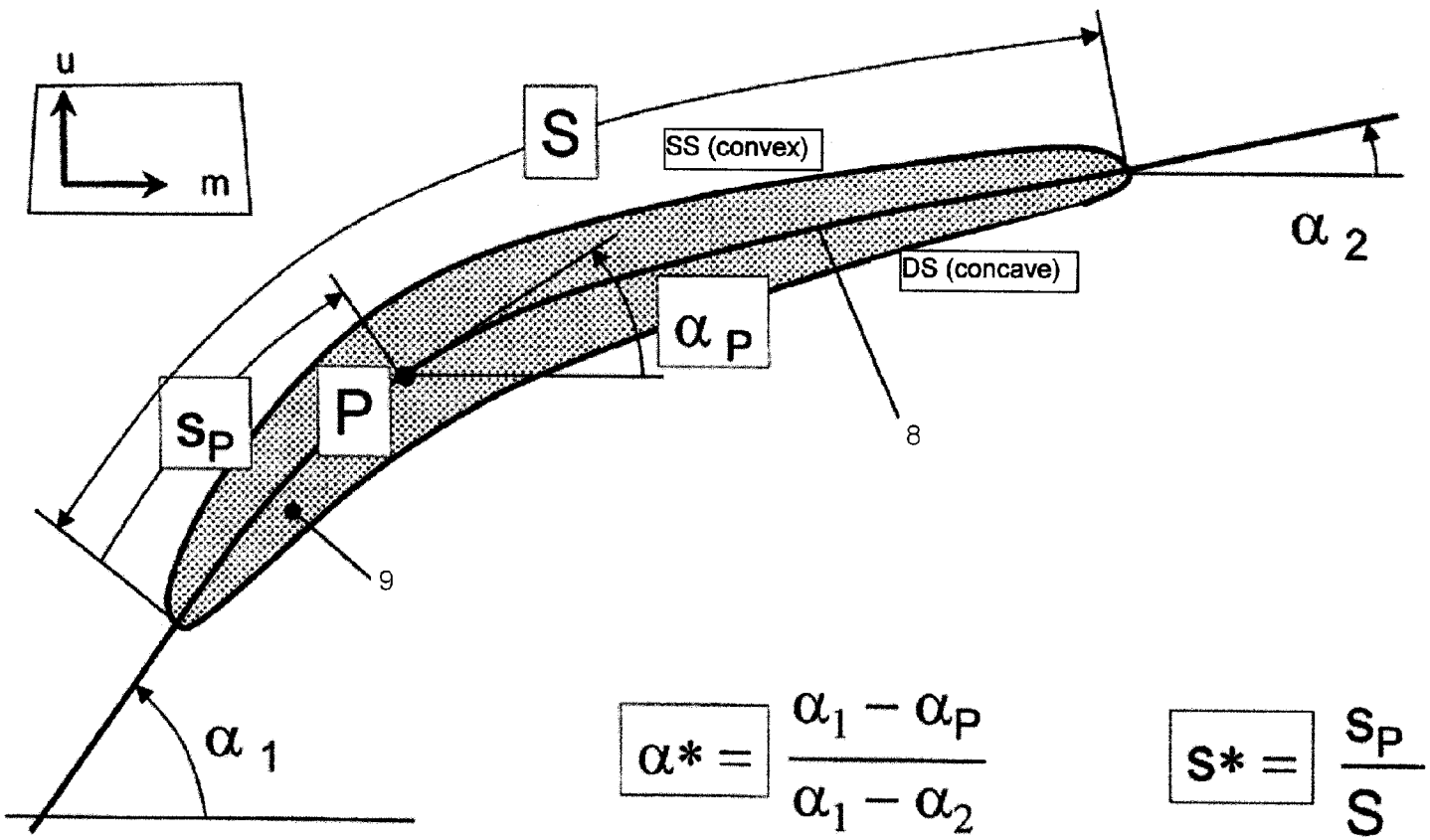

The right-hand side of FIG. 1 shows different state-of-the-art distributions of the skeleton line camber in profile section directly at the running gap, represented as relative camber $\alpha^*$ over the related running length $s^*$ (see FIG. 3 for definitions). Characteristic of all camber distributions is the virtual absence of values of the relative camber of $\alpha^* \geqq 0.35$ or even $\alpha^* \geqq 0.50$ or $\alpha^* \geqq 0.65$ with a related running length of $s^* \geqq 0.1$. Thus, an extreme loading of the leading edge is deliberately avoided. This category includes the so-called CDA (controlled diffusion airfoils) according to U.S. Pat. No. 4,431,376 A. Aerodynamically, CDA aim at a moderate profile front load.

The state of the art is disadvantageous in that the respective blade forms are designed, often deliberately, with low complexity regarding the shape of the skeleton line. Lacking in the case of strong running gap leakage flows is an excessive profile camber in the leading edge area of the blade profile sections in the vicinity of the running gap to appropriately combine a usual skeleton line camber distribution which is favorable in the blade center area with a skeleton line camber distribution which is more favorable for the edge areas.

A broad aspect of the present invention is to provide a rotor blade or a stator vane of the type specified at the beginning above which, while avoiding the disadvantages of the state of the art, is characterized by exerting an effective influence on the peripheral flow due to an excessive skeleton line camber in the area of the leading edge of the blade profile sections near the running gap.

According to the present invention, a blade of a fluid flow machine is therefore provided which is arranged in a main flow path confined by a hub and a casing, with a gap being provided between one end of the blade and the main flow path confinement, hub or casing, and with a free blade end thus being provided, with a skeleton line camber distribution having an excessive value of the relative skeleton line camber of $\alpha^* \geqq 0.35$ for a related running length of $s^*=0.1$ being provided in at least one blade profile flow line section in the area between the gap and a blade section at a distance of 30 percent of the main flow path width W from the gap, with $s^*$ being the local running length relative to the total running length of the profile skeleton line and $\alpha^*$ being formed as the angular change of the skeleton line relative to the total camber of the skeleton line achieved from the leading edge to a related running length $s^*$, with the skeleton line camber distribution in this representation commencing at the leading edge point V ($s^*=0$, $\alpha^*=0$) and terminating at the trailing edge point H ($s^*=1$, $\alpha^*=1$).

As presented in particular in FIG. 4*c* (see description below), a very high increase in flow deflection is provided in the forward area of the blade.

The present invention can also be described as follows:

Blade of a fluid flow machine which is arranged in a main flow path confined by a hub and a casing, with a gap being provided between one end of the blade and the main flow path confinement, hub or casing, and with a free blade end thus being provided, with a skeleton line camber distribution having an excessive value of the relative skeleton line camber of $\alpha^* \geqq 0.35$ for a related running length of $s^*=0.1$ being provided in at least one blade profile flow line section in the area between the gap and a blade section at a distance of 30 percent of the main flow path width W from the gap, with $s^*$ being the local running length relative to the total running length of the profile skeleton line and $\alpha^*$ being formed as the angular change of the skeleton line relative to the total camber of the skeleton line achieved from the leading edge to a related running length $s^*$, with the skeleton line camber distribution in this representation commencing in the leading edge point V ($s^*=0$, $\alpha^*=0$) and terminating in the trailing edge point H ($s^*=1$, $\alpha^*=1$), with a skeleton line camber distribution being provided, in particular at least directly at the gap, which for a related running length of $s^*=0.1$ has an excessive value of the relative skeleton line camber of $\alpha^* \geqq 0.35$, and/or with a skeleton line camber distribution being provided, at least within 5% of the main flow path width adjoining the gap, which for a related running length of $s^*=0.1$ has an excessive value of the relative skeleton line camber of $\alpha^* \geqq 0.35$, with preferably, for a related running length of $s^*=0.1$, an excessive value of the relative skeleton line camber of $\alpha^* \geqq 0.50$ being provided, with preferably the skeleton line camber distribution starting with high gradient in the leading edge point V and, in the further course, approaching with descending gradient the related running length $s^*=0.1$, with preferably the skeleton line camber distribution continuing from the related running length $s^*=0.1$ in the direction of the trailing edge point H up to the trailing edge point H without bent and with descending or constant gradient, with the point of maximum curvature of the skeleton line camber distribution being provided in the area $0 \leqq s^* \leqq 0.2$, with advantageously the skeleton line camber distribution continuing from the related running length $s^*=0.1$ towards the trailing edge point H without bending with initially further descending gradient and, from a point T in which the camber changes its sign, having an again rising gradient for at least a part of the area $0.1 \leqq s^* \leqq 1$, with further preferably the skeleton line camber distribution having only a single sign change and, therefore, showing an S-shaped course, and/or the point T of the first camber sign change being provided in the area $0.35 \leqq s^* \leqq 0.65$, with preferably the skeleton line camber distribution further extending, at least in a part of the area $0.1 \leqq s^* \leqq 1$, at constant values of the relative skeleton line camber $\alpha^*$, and/or the skeleton line camber distribution, for a related running length of $s^*=0.9$, having a value of the relative skeleton line camber of $\alpha^* < \alpha^*(s^*=0.1)+0.75\ (1-\alpha^*(s^*=0.1))$, and/or the skeleton line camber distribution extending cambered, cambered in sections or rectilinear in sections, thus having any number of bending points between the leading edge point V and the trailing edge point H, with further preferably an excessive value of the relative skeleton line camber of $\alpha^* \geqq 0.65$ being provided for a related running length of $s^*=0.1$, with further preferably an excessive value of the relative skeleton line camber of $\alpha^* \geqq 1.0$ being provided for a related running length of $s^*=0.1$, and/or values of the relative skeleton line camber of $\alpha^*>1$ being provided in at least a part of the running length of $0.1 \leqq s^* \leqq 1$.

The present invention is more fully described in light of the accompanying drawings showing preferred embodiments. In the drawings, FIG. 1 is a schematic representation of the state of the art, FIG. 2 provides a definition of meridional flow lines and flow line profile sections, FIG. 3 provides a definition of the skeleton line of a flow line profile section, FIG. 4*a* provides solutions in accordance with the present invention, FIG. 4*b* provides further solutions in accordance with the present invention, FIG. 4*c* provides further solutions in accordance with the present invention.

FIG. 2 provides a precise definition of the meridional flow lines and flow line profile sections. The central meridional flow line 7 is established by the geometrical center of an annulus 6. If a normal is erected at any point of the central flow line 7, the annulus width W along the flow path and a number of normals are obtained, these enabling further meridional flow lines to be produced, with same relative division in the direction of the duct height. The intersection of a meridional flow line with a blade produces a flow line profile section.

The respective type of skeleton line for a flow line profile section is defined in relative representation by way of the relative camber $\alpha^*$ and the related running length $s^*$, see FIG. 3. The figure shows a flow line profile section of the blade on a meridional flow area (u-m plane).

For this, the angle of inclination $\alpha_P$ and the running length $s_P$ covered so far are determined in all points of the skeleton line. For reference, the inclination angle at the leading and trailing edge $\alpha_1$ and $\alpha_2$ and the total running length of the skeleton line S are used. The following applies:

$$\alpha^* = \frac{\alpha_1 - \alpha_P}{\alpha_1 - \alpha_2} \quad S^* = \frac{s_P}{s}$$

FIG. 4*a* shows a set of gap-near distributions of the profile skeleton line camber according to the present invention. They are characterized in that, for related running lengths of $s^*=0.1$, the relative skeleton line camber $\alpha^*$ invariably has values greater than or equal to 0.35.

In accordance with the present invention it is further advantageous if, for related running lengths of $s^*=0.1$, the relative skeleton line camber $\alpha^*$ always has values greater than or equal to 0.50. In particular cases, it may even be favorable according to the present invention if the relative skeleton line camber $\alpha^*$ assumes the value 0.65 or greater or even 1.0 or greater as of a related running length of $s^*=0.1$.

The uppermost distribution in FIG. 4*a* represents, according to the present invention, the special case of a change of sign of the skeleton line camber. In the case here represented, the skeleton line is convex towards the profile suction side in part of the running length $s^*$ and concave in a bottom part of the running length $s^*$, as it arises if values of $\alpha^*>1$ are provided in at least part of the running length $s^*$.

The value of $\alpha^*$ at $s^*=0.1$ is hereinafter designated by $\alpha^*_B$, i.e. $\alpha^*_B=\alpha^*(s^*=0.1)$. Analogically, the value of $\alpha^*$ at $s^*=0.9$ is hereinafter designated by $\alpha^*_C$, i.e. $\alpha^*_C=\alpha^*(s^*=0.9)$. The corresponding points on the skeleton line camber distribution are marked B and C, see FIG. 4*c*.

According to the present invention, a deliberate departure is accordingly made from the solution principles known from the state of the art. According to the present invention, an excess loading of the profile leading edge region in the vicinity of the running gap favorably influences the leakage flows occurring at the running gap. According to the present invention, this is obtained with values of the relative skeleton line camber $\alpha^*$ of greater than or equal to 0.35 or even greater than or equal to 0.5 or, in particular cases, greater than or equal to 0.65 or, in extreme cases, greater than or equal to 1.0 even, for a relative running length of $s^*=0.1$.

The skeleton line camber distributions according to the present invention can extend curved, curved in sections or rectilinear in sections and, accordingly, have any number of bending points between their starting point V ($s^*=0$, $\alpha^*=0$) at the leading edge and their end point H ($s^*=1$, $\alpha^*=1$) at the trailing edge as long as they fulfil the basic criterion according to the present invention, i.e. $\alpha^*_B=\alpha^*(s^*=0.1) \geqq 0.35$ or $\alpha^*_B \geqq 0.5$ or $\alpha^*_B \geqq 0.65$ or $\alpha^*_B \geqq 1.0$.

According to the present invention, as shown in FIG. 4*a*, a camber distribution of $\alpha^*=f(s^*)$ is favorable which, while commencing with high gradient in starting point A, approaches the point B with a descending gradient in its further course. Also favorable according to the present invention is a bent-free continuation of the camber distribution from point B with further descending or constant gradient to the trailing edge point H, with the strongest curvature of the camber distribution being provided in the area $0 \leqq s^* \leqq 0.2$, in accordance with the set of camber distributions according to the present invention shown in FIG. 4*a* which, in particular, is suitable for low and moderate aerodynamic profile loads.

FIG. 4*b* shows, again in accordance with the present invention, a set of skeleton line camber distributions which is suitable also for aerodynamically highly loaded profiles. While commencing with large gradients in the area $0 \leqq s^* \leqq 0.1$, it is in this case favorable according to the present invention to progress the skeleton line camber distribution with an initially further descending gradient and then again rise the gradient from a point T in the area $0.1 \leqq s^* \leqq 1$. This means that the curvature changes its sign at point T.

In the special case that the gradient increases continually from point T, an S-shaped skeleton line camber distribution is obtained, in accordance with the present invention as per the set shown in FIG. 4*b*. Particularly favorable according to the present invention is a position of the point T in the area $0.35 \leqq s^* \leqq 0.65$.

It can also be favorable according to the present invention if the skeleton line camber distribution extends at constant values of $\alpha^*$ in at least part of the area $0.1 \leqq s^* \leqq 1$, see bottommost skeleton line camber distribution in FIG. 4*b*.

FIG. 4*c* shows a further skeleton line camber distribution according to the present invention which provides for a certain distribution of the increase in camber achieved in the area $0.1 \leqq s^* \leqq 1$. For this, the value $\alpha^*_C$ provided at $s^*=0.9$, and thus the position of point C, are limited. Thus, particularly favorable solutions according to the present invention are obtained, if: $\alpha^*_C < \alpha^*_B + 0.75\,(1-\alpha^*_B)$.

The skeleton line camber distribution according to the present invention is to be provided in at least one blade flow line section in the area between the gap and a blade section at 30 percent of the main flow path width (0.3 W).

Particularly favorable is a skeleton line camber distribution in accordance with the present invention provided at least directly at the gap and over at least further 5 percent of the main flow path width W adjoining the gap.

Very favorable is a skeleton line camber distribution in accordance with the present invention applied at least directly at the gap. The inventive blade for fluid flow machines, such as blowers, compressors, pumps and fans influences the boundary flow such that the efficiency of each stage can be increased by approx. 0.3% with stability remaining unchanged. Furthermore a reduction of the blade numbers of up to 20% is possible. The concept of the present invention is applicable to different types of fluid flow machines and leads to reductions in cost and weight of the fluid flow machine ranging between 2% and 10%, depending on its degree of utilization. It also leads to an improvement of the total efficiency of the fluid flow machine of up to 1.5%, depending on the application.

| List of reference numerals | |
|---|---|
| 1 | Casing |
| 2 | Hub |
| 3 | Machine axis (rotational axis) |
| 4 | Rotor (rotor blade row) |
| 5 | Stator (stator vane row) |
| 6 | Annulus (main flow path) |
| 7 | Central meridional flow line |
| 8 | Profile skeleton line |

-continued

| List of reference numerals | |
|---|---|
| 9 | Flow line cross-section |
| 10 | Gap |

What is claimed is:

1. A blade for a fluid flow machine, comprising:

the blade being arranged in a main flow path of the fluid flow machine, a hub and a casing of the fluid flow machine forming a main flow path confinement confining the main flow path, the blade having a free end such that a gap is formed between the free end of the blade and the main flow path confinement, the blade having a skeleton line camber distribution having an excessive value of a relative skeleton line camber of $\alpha^* \geqq 0.35$ for a related running length of $s^*=0.1$ in at least one blade profile flow line section in an area between the gap and a blade section at a distance of 30 percent of the main flow path width W from the gap, where s* is a local running length relative to a total running length of the profile skeleton line and $\alpha^*$ is an angular change of the skeleton line relative to the total camber of the skeleton line achieved from the leading edge to a related running length s*, with the skeleton line camber distribution commencing at a leading edge point V ($s^*=0$, $\alpha^*=0$) and terminating at a trailing edge point H ($s^*=1$, $\alpha^*=1$).

2. The blade of claim 1, wherein the skeleton line camber distribution is provided at least directly at the gap, which for a related running length of $s^*=0.1$ has an excessive value of the relative skeleton line camber of $\alpha^* \geqq 0.35$.

3. The blade of claim 2, wherein the skeleton line camber distribution is provided at least within 5% of a main flow path width adjoining the gap, which for a related running length of $s^*=0.1$ has an excessive value of the relative skeleton line camber of $\alpha^* \geqq 0.35$.

4. The blade of claim 3, wherein for a related running length of $s^*=0.1$, an excessive value of the relative skeleton line camber is $\alpha^* \geqq 0.50$.

5. The blade of claim 4, wherein the skeleton line camber distribution starts with high gradient at the leading edge point V and, in the further course, approaches with descending gradient the related running length $s^*=0.1$.

6. The blade of claim 5, wherein the skeleton line camber distribution continues from the related running length $s^*=0.1$ in a direction of the trailing edge point H up to the trailing edge point H without bending and with at least one of descending and constant gradient, with a point of maximum curvature of the skeleton line camber distribution being provided in an area $0 \leqq s^* \leqq 0.2$.

7. The blade of claim 5, wherein the skeleton line camber distribution continues from the related running length $s^*=0.1$ towards the trailing edge point H without bending with initially further descending gradient and, from a point T in which the camber changes its sign, has an again rising gradient for at least a part of an area $0.1 \leqq s^* \leqq 1$.

8. The blade of claim 7, characterized in that the skeleton line camber distribution has only a single camber sign change and shows an S-shaped course.

9. The blade of claim 8, wherein the point T of the camber sign change is provided in an area $0.35 \leqq s^* \leqq 0.65$.

10. The blade of claim 9, wherein the skeleton line camber distribution extends, at least in a part of the area $0.1 \leqq s^* \leqq 1$, at constant values of the relative skeleton line camber $\alpha^*$.

11. The blade of claim 10, wherein the skeleton line camber distribution, for a related running length of $s^*=0.9$, has a value of the relative skeleton line camber of $\alpha^*<\alpha^*(s^*=0.1)+0.75(1-\alpha^*(s^*=0.1))$.

12. The blade of claim 11, wherein the skeleton line camber distribution extends in at least one of cambered, cambered in sections and rectilinear in sections, and has any number of bending points between the leading edge point V and the trailing edge point H.

13. The blade of claim 7, wherein the point T of a first camber sign change is provided in an area $0.35 \leqq s^* \leqq 0.65$.

14. The blade of claim 1, wherein for a related running length of $s^*=0.1$, an excessive value of the relative skeleton line camber is $\alpha^* \geqq 0.50$.

15. The blade of claim 1, wherein the skeleton line camber distribution starts with high gradient at the leading edge point V and, in the further course, approaches with descending gradient the related running length $s^*=0.1$.

16. The blade of claim 1, wherein the skeleton line camber distribution continues from the related running length $s^*=0.1$ in a direction of the trailing edge point H up to the trailing edge point H without bending and with at least one of descending and constant gradient, with a point of maximum curvature of the skeleton line camber distribution being provided in an area $0 \leqq s^* \leqq 0.2$.

17. The blade of claim 1, wherein the skeleton line camber distribution continues from the related running length $s^*=0.1$ towards the trailing edge point H without bending with initially further descending gradient and, from a point T in which the camber changes its sign, has an again rising gradient for at least a part of an area $0.1 \leqq s^* \leqq 1$.

18. The blade of claim 1, characterized in that the skeleton line camber distribution has only a single camber sign change and shows an S-shaped course, wherein a point T of the camber sign change is provided in an area $0.35 \leqq s^* \leqq 0.65$.

19. The blade of claim 1, wherein the skeleton line camber distribution extends, at least in a part of the area $0.1 \leqq s^* \leqq 1$, at constant values of the relative skeleton line camber $\alpha^*$.

20. The blade of claim 10, wherein the skeleton line camber distribution, for a related running length of $s^*=0.9$, has a value of the relative skeleton line camber of $\alpha^*<\alpha^*(s^*=0.1)+0.75(1-\alpha^*(s^*=0.1))$.

* * * * *